United States Patent [19]

Sherwood

[11] 4,054,345

[45] Oct. 18, 1977

[54] CONNECTOR ASSEMBLY

[75] Inventor: Theodore R. Sherwood, Sunnyvale, Calif.

[73] Assignee: The United States of America as represented by the Secretary of the Navy, Washington, D.C.

[21] Appl. No.: 653,329

[22] Filed: Jan. 29, 1976

[51] Int. Cl.[2] ..... H01R 21/02

[52] U.S. Cl. ..... 339/17 M; 339/221 M

[58] Field of Search ..... 339/17 R, 17 C, 17 M, 339/17 LC, 17 A, 64 M, 66 M, 157 R, 221 R, 221 L, 221 M, 275 B

[56] References Cited

U.S. PATENT DOCUMENTS

| | | | |
|---|---|---|---|
| 3,208,026 | 9/1965 | Ruehlemann | 339/17 LC |
| 3,539,974 | 11/1970 | Berg | 339/275 B |
| 3,634,816 | 1/1972 | Zell | 339/17 M |
| 3,670,294 | 6/1972 | Johnson et al. | 339/221 M |
| 3,697,933 | 10/1972 | Black et al. | 339/17 C |
| 3,850,492 | 11/1974 | Moore | 339/64 M |
| 3,864,000 | 2/1975 | Coller et al. | 339/17 LC |

FOREIGN PATENT DOCUMENTS

| | | | |
|---|---|---|---|
| 2,021,547 | 11/1971 | Germany | 339/186 M |

OTHER PUBLICATIONS

Bendix Electrical Components Division, "Product Data Sheet PCB Connector", Mar. 1971, Series 310, Syle C, Publication No. 82.

*Primary Examiner*—Gerald A. Dost
*Attorney, Agent, or Firm*—R. S. Sciascia; Charles D. B. Curry; Elliott N. Kramsky

[57] ABSTRACT

A connector assembly to complete electrical connection between packaged electrical components. A connector header and a lead-in header commute by means of internal channels to form paths for an array of contact pins. Each pin is dimpled for self-retention in a channel after insertion. The design of the connector header allows continual access to the pins for individual removal in case of failure. Header design is symmetrical, allowing fabrication of a variety of connector lengths from a single mold.

7 Claims, 5 Drawing Figures

CONNECTOR ASSEMBLY

BACKGROUND OF THE INVENTION

1. Field of the Invention

The present invention relates to electrical connectors. In particular it relates to devices especially appropriate for accomplishing electrical connection between a multi-layer (or printed circuit) board and a master interconnect board.

2. Description of the Prior Art

Electrical connector apparatus and methods in present technology continually encounter design and concept problems related to the progressive miniaturization of electrical components. A commonly encountered situation involves the connection of a multitude of multi-layer, also known as printed circuit, boards to a master interconnect board. Applications may arise in computers, missiles, memory systems or any number of sophisticated present day electronic systems. It is often necessary and desirable to achieve compact design of the master interconnect board, thereby minimizing the area into which the multi-layer boards must be "ganged".

The efficient utilization of the many inputs afforded by a master interconnect board often time dictates that a very dense contact pin array join the individual multi-layer boards to the master interconnect board. Also, a 90° or edge to surface relationship between the multi-layer and master interconnect boards often proves quite space saving. Efficient design may be hampered if the inherent physical materials and stability limitations of the contact pins and attendant manufacturing processes are not solved.

Previous methods in the area of the present invention were hampered by designs which provided high insertion force stresses to the delicate pin contacts, making blind insertion and close location impossible to achieve. Additionally, prior designs did not provide access to the individual pins so that a partially-defective connection could be partially unsoldered and thus salvaged. An additional failure of the prior art was the inability of the pins to be simply retained in position during critical joinder processes such as the application of wave soldering techniques to secure the pins to multi-layer boards. Often complex supplemental equipment was employed to achieve critical stability. See, for example, Shultz, U.S. Pat. No. 3,800,416.

The present invention solves this and other problems by means of a connector header of unique design which allows access to individual pins for unsoldering joined to a lead-in header which guides the pins so they may encounter zero insertion force when mated into the master interconnect board. A dimple is provided on each contact pin for retention in the connector assembly during soldering or other attachment processes.

SUMMARY OF THE INVENTION

Briefly, the present invention comprises a connector header and a lead-in header which commute by means of internal channels to form paths for an array of contact pins. Each pin is dimpled for self-retention in a channel after insertion. The design of the connector header allows continual access to the pins for individual removal in case of failure. Header design is symmetrical, allowing fabrication of a variety of connector lengths from a single mold.

OBJECTS OF THE INVENTION

An object of the present invention is to provide a high contact pin density electrical connection between two boards.

Another object of the present invention is to provide an electrical connection of simplified design between two boards.

Yet another object of this invention is to provide an electrical connection between two boards by means of a design which allows a simple method of varying the size of the connector apparatus.

A further object of the present invention is to provide an electrical connector which allows individual pin removal without destruction of the entire connection.

Still another object of the present invention is to provide a simplified method of retaining a contact pin in place during soldering or other fastening processes.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
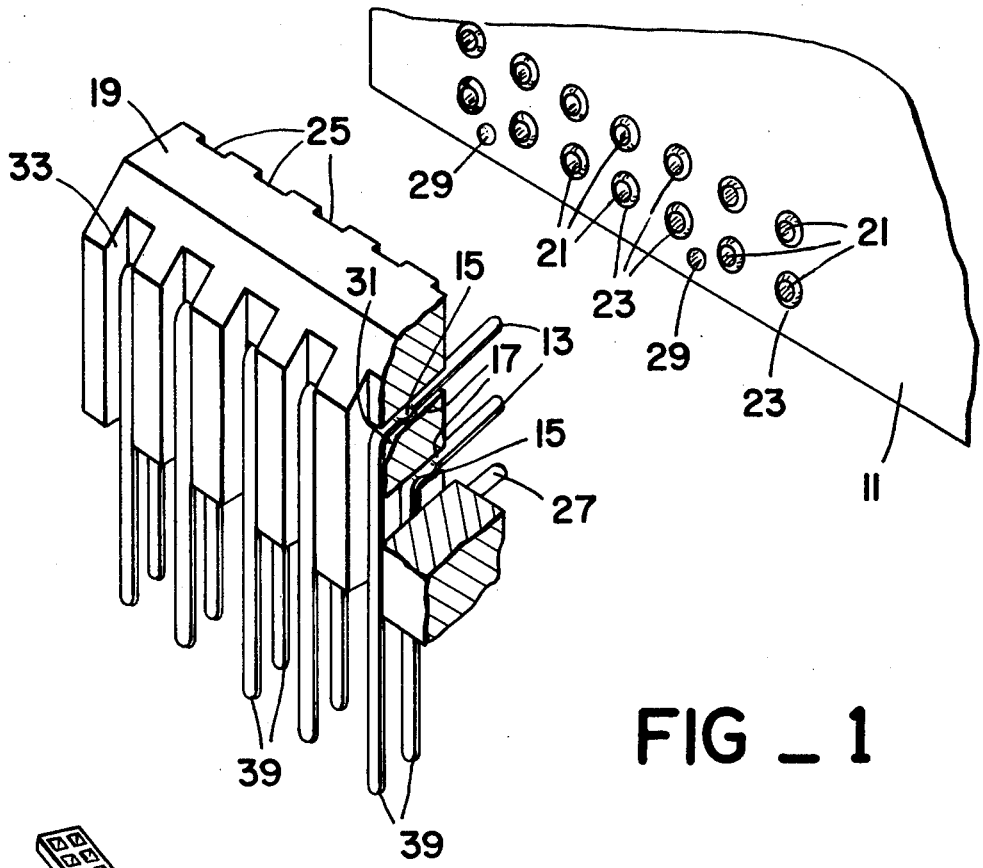
FIG. 1 is a perspective view of the connector header and inserted contact pins of the present invention.

Attention is now directed to FIG. 1 wherein there is shown in perpective a partial assembly of the present invention. A multi-layer board 11, also commonly denoted printed circuit board, is positioned for the attachment of a plurality of pin contacts 13. An important advantage and feature of the present invention is that the pins 13 accommodated in the manner of the present invention may be of very slender dimension. The objectives of the present invention, including blind insertion with substantially reduced danger of bending, may be achieved, for example, with pins 13 of a thickness of 0.01 inch and a width of 0.0025 inch. Such dimensions are given merely to enumerate a specific operational selection of pins 13 and are by no means intended to in any way limit the scope of the present invention.

Each pin 13 is seen to have a dimple 15 in its horizontal portion. The dimple 15 serves to retain the pin 13 within horizontal chamber 17 of connector header 19. Thus it requires no additional apparatus specifically designed to retain the pin 13 within connector header 19 for the wave soldering process to be described more fully below.

It is seen that the typical multi-layer board 11 will comprise one or more rows of holes 21 for insertion of contact pins 13. Such holes generally have a metallic lining in the form of a collar 23. Copper having a "tinned" coating is an example of such metallic collar 23. To accommodate such a protruding collar 23 when the connector header 19 is to be mounted flush to the multi-layer board 11 there are provided a plurality of recesses 25 in the face of connector header 19.

The header 19 is so designed that the horizontal chambers 17 will locate a plurality of pins 13 simultaneously in the desired multi-layer board holes 21. A plurality of alignment posts 27 are designed to line up with a matching plurality of alignment holes 29 of the multi-layer board 11 to provide a stable and aligned relationship between connector header 19 and the multi-layer board 11. Thus, the delicate pins 13 are protected from any shear stress after alignment has taken place.

The connector header 19 is seen to comprise two internal sets of passageways. The passageways each contain a horizontal chamber 17, an angled chamber 31 and a vertical chamber 33. They are designed to accommodate pins 13 having a 90 degree bend. Such construction is especially advantageous in the case of the coupling of a plurality of multi-layer boards 11 to a master interconnect board 35. The 90° bend in such a pin 13 allows the attachment of the multi-layer boards 11 in such a way as to consume minimal surface area of the master interconnect board 35 thereby assuring maximum simultaneous utilization of the master interconnect board inputs 37. By achieving a connector head 19 in which the bent portion of the delicate contact pins 13 may be contained, and thereby supported, stiffness is added to the otherwise flimsy pins 13.

In operation, the wiring of a multi-layer board 11 to a master interconnect board 35 is accomplished by first manually loading a plurality of pins 13 into connector header 19. Oftentimes a plurality of pins 13 is joined together by a rail (not shown) running along the bottom portions 39 of the pins 13. Such a rail allows simultaneous placement of the plurality of pins 13 and may be removed prior to insertion of the lower portions 39 into the master interconnect board inputs 37. The design of the vertical chamber portion 33 allows access to the horizontal chamber portion 17 from the rear. Thus one may input the 90° bent pins directly into connect header 19 while employing no rotation of connector header 19. This avoids the imposition of potentially damaging torque on the delicate pins 13.

Once arrayed properly in connector header 19, the header is joined to the multi-layer board 11 by matching the corresponding alignment posts 27 to multi-layer board holes 29. The pins 13 are retained securely by the dimples 15 of their horizontal portions during this process, allowing manual achievement of the joinder by one operator. Wave soldering, a process involving the mechanical generation of a surge of hot solder, may be applied upon the side of the multi-layer board 11 opposite connector header 19. The present invention, however, is by no means to be limited in application to such an attachment technique which is only mentioned by way of example. Generally the multi-layer board 11 may be expected to be constructed of epoxy glass or some other insultor which solder will not wet. Solder will adhere to the metallic collars 23 lining the multi-layer board holes 21, forming a surrounding meniscus of solder. The non-wetting of the spaces between holes 21 assures that no short circuits will be introduced into multi-layer board 11 by the wave soldering process.

Figure 2:
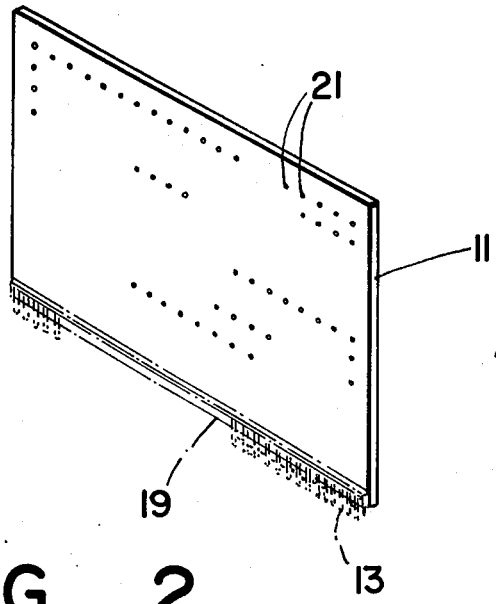
FIG. 2 is a perspective view of a multi-layer board with pins arrayed thereon according to the present invention.

Upon completion of the wave soldering of the pins 13 to multi-layer board 11 a standard milling machine or its equivalent (not shown) may be employed to fly cut the protruding ends of the soldering pins 13 to a uniform height. A typical height desirable for present technologies would be approximately .03 inches. In FIG. 2 there is shown a perspective view of the high density ganging of contact pins 13 to a multi-layer board 11 which may be achieved by the above-described process.

After the pins 13 have been affixed to multi-layer board 11 the rail (not shown) which may have been employed to allow the simultaneous placement of a plurality of the pins 13 into connector header 19 may be broken from the lower portion 39 of the pins to allow the insertion of the lower portions 39 into lead-in header 41.

Figure 3:
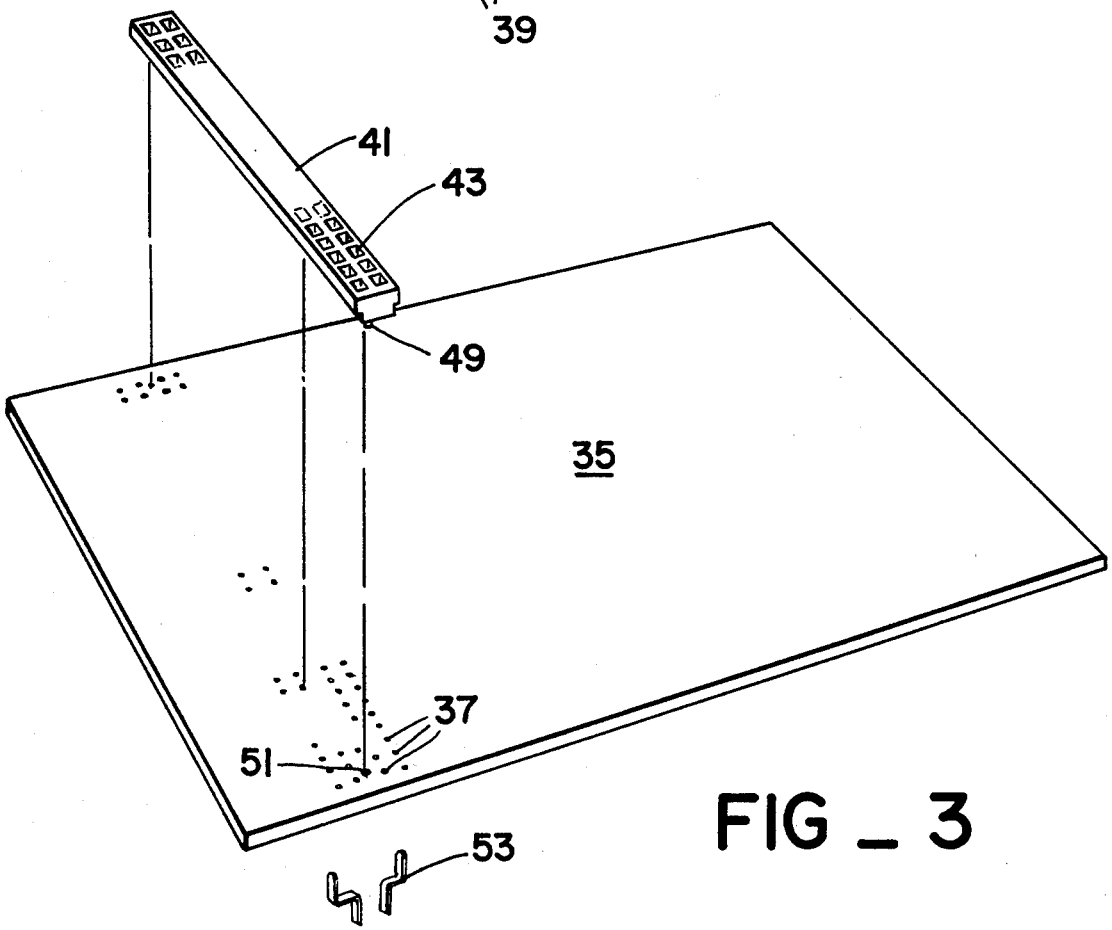
FIG. 3 is a perspective view of the lead-in header of the present invention.

There is shown in FIG. 3 the lead-in header 41 of the present invention positioned for joinder to master interconnect board 35. Leadin header 41 is seen to comprise two rows of guides 43. The guides are matched at their top portion 45 to the lower portions 39 of contact pins 13 and at their lower portions 47 to the master interconnect board inputs 37.

Figure 4:
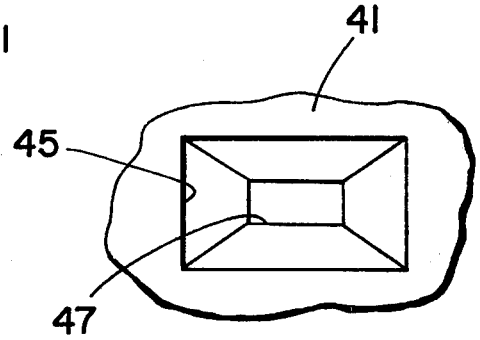
FIG. 4 is a top view of the lead-in header of the present invention.
Figure 5:
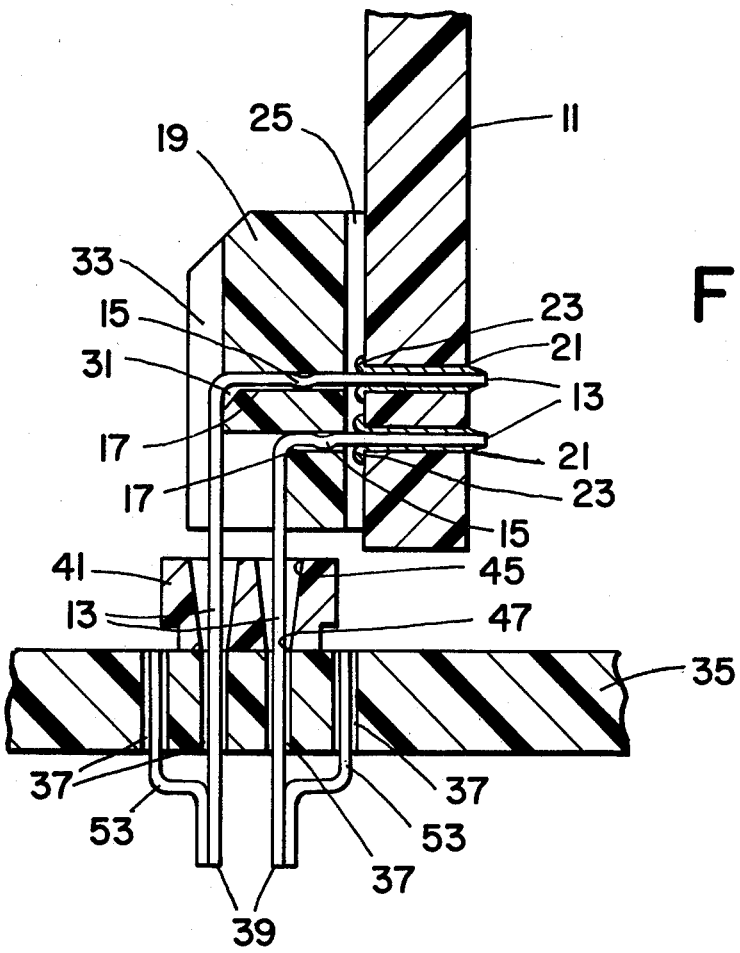
FIG. 5 is a side view of the electrical connection of a multi-layer board and a master interconnect board according to the present invention.

Referring to FIG. 4 it is seen that the lower portion 47 of guide 43 is of somewhat smaller cross section than its upper portion 45. The lower portion 47 additionally is of slightly greater cross section than pin 13. The internal taper achieved by the guide 43 assures a zero force fit throughout each guide 43 and provides a means for correction of potential misalignment of the pins 13. The alignment posts 49 of lead-in header 41 are matched to corresponding alignment holes 51 of master interconnect board 35 to assure the matching of header guides 43 with master interconnect board inputs 37. The lower portions 39 of the pins 13 which extend from the connector header 19 may be manually filled into the proper header guides 43. Upon insertion of the pins 13 into lead-in header 41, wire wrap pins 53 from an electrical source (not shown) may be joined to the pins 13 by one of numerous methods well known in the art to complete the numerous desired electrical connections from the desired electrical sources to the multi-layer board 11. The fully completed electrical connection of a wire wrap pin 53 to a multilayer board 11 according to the present invention may be seen in FIG. 5.

It may be seen throughout that symmetry of design is achieved by the present connector assembly. Such symmetry allows the achievement of a compact electrical connection between boards of various pin densities and sizes from one standard mold. Considerable economy in manufacture and assembly is occasioned by the employment of a header design which allows the mechanical guillotining of unnecessary contacts as opposed to separate molding of desired lengths. The present invention has been molded operationally of diallyl phthalate resin, for example, to a full length of 6.4 inches, thereby holding 64 pins in a single row.

Thus it is seen that highly economical multi-layer board lead connector is achieved that allows the efficient placement of a high density of delicate contacts with minimal risk of injury to the contacts.

What is claimed is:

1. A connector to make electrical connection between a first board and a second board which comprises:

a. a first header having a first face portion oriented parallel to said first board and a second face portion oriented parallel to said second board, and having a plurality of channels therethrough, each of said channels having an enclosed horizontal portion perpendicular to said first face portion and extending throughout said first header and a vertical portion perpendicular to said second face portion which is non-inclusive throughout its length;

b. a plurality of elongated pins of electrical conducting material, each of said pins having a 90° bend which is accommodated by said channels and a dimpled section for inserting into said channels such that when said pins are inserted in said channels said dimpled sections contact said channels to retain said pin; and c. a second header having a top located adjacent said second face portion and a bottom located adjacent said second board, and having a plurality of channels therethrough for said pins to pass through;

whereby removal of individual pins is allowed without breaking total electrical connection.

2. A connector as described in claim 1 wherein:

a. said channels in said second header have a larger cross section in said top than in said bottom and being tapered therethrough; whereby b. said pins extending from said second face portion of said first header through said second header will encounter minimal insertion force throughout said second header.

3. A connector as described in claim 2 wherein:

a. said first board to be connected has at last two holes; and b. said connector additionally comprises at least two posts in said first face portion of said first header to align with said at least two holes in said first board and maintain said board and said header in a predetermined alignment.

4. A connector as described in claim 3 wherein:

a. said second board to be connected has at least two holes; and b. said connector additionally comprises at least two posts in said bottom of said second header to align with said at least two holes in said second board and maintain said board and said second header in predetermined alignment.

5. A connector as described in claim 4 wherein:

a. said first header and said second header are constructed of diallyl phthalate resin.

6. A connector as described in claim 5 wherein:

a. said first face portion of said first header has recesses to accommodate any protrusions from the surface of said first board at the point of contact between said first face portion of said header and said first board.

7. A connector as described in claim 6 wherein:

a. said connector additionally comprises each of said channels in said first header having an angled portion joining said horizontal portion and said vertical portion.

* * * * *